US011380156B2

(12) United States Patent
Mertin et al.

(10) Patent No.: US 11,380,156 B2
(45) Date of Patent: Jul. 5, 2022

(54) ASSEMBLY HAVING A CARD READER ARRANGED IN A HOUSING

(71) Applicant: Wincor Nixdorf International GmbH, Paderborn (DE)

(72) Inventors: Nils Mertin, Erwitte (DE); Erich Kujat, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 16/978,796

(22) PCT Filed: Mar. 4, 2019

(86) PCT No.: PCT/EP2019/055278
§ 371 (c)(1),
(2) Date: Oct. 7, 2020

(87) PCT Pub. No.: WO2019/170587
PCT Pub. Date: Sep. 12, 2019

(65) Prior Publication Data

US 2021/0166516 A1 Jun. 3, 2021

(30) Foreign Application Priority Data

Mar. 8, 2018 (DE) ..... 102018105316

(51) Int. Cl.
*G07F 7/08* (2006.01)
*G07F 19/00* (2006.01)

(52) U.S. Cl.
CPC ..... *G07F 7/088* (2013.01); *G07F 19/205* (2013.01)

(58) Field of Classification Search
CPC ..... G07F 7/088; G07F 19/205; G07F 7/0873; G07F 7/0886; G07F 7/0893; G07F 19/00; G07F 19/20
See application file for complete search history.

(56) References Cited

U.S. PATENT DOCUMENTS 6,179,399 B1 1/2001 Brustle et al.
6,896,181 B2 * 5/2005 Utz ..... G06Q 20/1085 235/379

(Continued)

OTHER PUBLICATIONS

International Preliminary Report on Patentability for corresponding PCT application No. PCT/EP2019/055278, dated Sep. 8, 2020, written in German language; 7 pages.

(Continued)

*Primary Examiner* — Thien M Le
*Assistant Examiner* — April A Taylor
(74) *Attorney, Agent, or Firm* — Black, McCuskey, Souers & Arbaugh LPA

(57) ABSTRACT

A card reader is arranged in a housing including a pivotable flap, which in an opened state enables and in a closed state prevents access to the card reader. The flap has an opening, through which a card can be fed to or ejected by the card reader in the closed state of the flap. An elastically deformable element resiliently supports the card reader. A first positioning element for positioning the card reader is arranged on the flap to lie opposite the card reader in the closed state of the flap. When the flap is moved from the open state into the closed state, the first positioning element moves the card reader in such a way that the card reader is arranged in a predefined position relative to the flap in the closed state of the flap.

10 Claims, 6 Drawing Sheets

(56) References Cited

U.S. PATENT DOCUMENTS

| | | | | |
|---|---|---|---|---|
| 6,955,293 | B1 * | 10/2005 | Katsanevas | G07F 19/20 235/379 |
| 8,469,264 | B1 * | 6/2013 | Almeida | G07F 19/205 235/379 |
| 2004/0222296 | A1 | 11/2004 | Douglass et al. | |

OTHER PUBLICATIONS

English translation of International Preliminary Report on Patentability for corresponding PCT application No. PCT/EP2019/055278, dated Sep. 8, 2020; 5 pages.

* cited by examiner

ASSEMBLY HAVING A CARD READER ARRANGED IN A HOUSING

CROSS-REFERENCE TO RELATED APPLICATIONS

This application is the National Stage Entry of and claims priority to and the benefit of Application PCT/EP2019/055278, filed 4 Mar. 2019, which claims priority to and the benefit of Application DE102018105316, filed 8 Mar. 2018.

BACKGROUND AND SUMMARY

The invention relates to an assembly with a card reader which is arranged in a housing. The housing comprises a pivotable flap which, in an open state, enables access to the card reader, and which, in a closed state, prevents access to the card reader. The flap has an opening, through which, in the closed state of the flap, a card can be fed to the card reader and/or can be dispensed by way of the card reader.

Document DE10 2011 118 319 A1 discloses a lottery terminal with a terminal housing. The terminal housing comprises a plurality of spatially separate functional unit receiving areas. A card reading unit is arranged in one of the functional unit receiving areas. The access to the card reading unit is prevented by way of a closure flap. A recess is configured in the closure flap, which recess permits the introduction and removal of a card into or from the card reading unit when the closure flap is in a closed state. In the case of the movement of the closure flap from an open state into a closed state, the recess of the closure flap has to be moved into a position which lies opposite the card reading unit, in order that an introduction and dispensing of a card are possible in the closed state of the flap. The position of the recess in relation to the card reading unit can change as a result of shape and positional tolerances, with the result that the introduction and dispensing of the card is no longer reliably possible.

Proceeding from the known prior art, it is an object of the invention to specify an assembly with a card reader which is arranged in a housing, in the case of which assembly an introduction and dispensing of a card into or from the card reader are particularly reliably possible in the closed state of the flap.

Said object is achieved by way of an assembly with the features of claim 1. Advantageous developments are indicated in the dependent claims.

The assembly according to the invention has a card reader which is arranged in a housing. The housing comprises a pivotable flap which, in an open state, enables access to the card reader, and which, in a closed state, prevents access to the card reader. The flap has an opening, through which a card can be fed to the card reader and/or can be dispensed by way of the card reader in the closed state of the flap. The assembly has an elastically deformable element for resiliently mounting the card reader. Furthermore, the assembly has a first positioning element for positioning the card reader, which first positioning element is arranged on the flap so as to lie opposite the card reader in the closed state of the flap. The first positioning element moves the card reader, in the case of the movement of the flap from the open state into the closed state, in such a way that, in the closed state of the flap, the card reader is arranged in a predefined position relative to the flap.

In the present application, the position relative to the flap is understood to mean both the spatial arrangement and the orientation with regard to the flap.

Mechanically particularly simple resilient mounting of the card reader in the housing is realized by way of the elastically deformable element. The resilient mounting of the card reader enables the card reader to be moved by way of the first positioning element in the case of the movement of the flap from the open state into the closed state. The elastically deformable element and the first positioning element interact, in order to move the card reader into the predefined position relative to the flap. Tolerances, in particular shape and positional tolerances, in the case of the movement of the flap are compensated for by way of the resilient mounting of the card reader. Therefore, the card reader is moved reliably into the predefined position in the case of the movement of the flap from the open state into the closed state; as a result of which an introduction and dispensing of a card into or from the card reader in the closed state of the flap are particularly advantageously possible.

The card reader is preferably inclined in the direction of the opening in the closed state of the flap. Said inclination can be, for example, by between 2° and 7°, preferably 5°, with respect to a horizontal orientation of the card reader. In the present application, the horizontal orientation is understood to mean an orientation of the card reader, in which orientation the card is introduced horizontally into the card reader or dispensed again by way of said card reader. As a result, a penetration of liquids, in particular rainwater, into the card reader is prevented.

It is advantageous if the elastically deformable element has a second positioning element. In the case of the movement of the flap from the open state into the closed state, the first positioning element is brought into engagement with the second positioning element in order to position the card reader. In the case of the movement of the flap from the open state into the closed state, the first positioning element is moved on a circular path into a position which lies opposite the card reader.

In one alternative refinement, the card reader has a second positioning element. In the case of the movement of the flap from the open state into the closed state, the first positioning element is brought into engagement with the second positioning element in order to position the card reader.

Furthermore, it is advantageous if the elastically deformable element is prestressed in such a way that the second positioning element is pressed against the first positioning element in the closed state of the flap. This prevents an undesired movement of the card reader in the closed state of the flap, for example as a result of shaking of the assembly. Therefore, the card reader is held particularly reliably in the predefined position relative to the flap.

Furthermore, it is advantageous if the elastically deformable element is prestressed by way of the weight of the card reader. As a result, an undesired movement of the card reader in the open state of the flap is prevented, by way of which undesired movement the card reader, for example, might come into contact with other components of the assembly which are arranged in the housing and might damage them. The elastically deformable element is preferably prestressed in such a way that, in the open state, the card reader is inclined by between 2° and 5°, preferably 3°, in the direction of the flap with respect to the horizontal orientation of the card reader.

The elastically deformable element is preferably of single-piece configuration. As a result, the assembly can be produced particularly simply and inexpensively.

It is particularly advantageous if the elastically deformable element comprises a spring plate. A spring plate is a mechanically simple and inexpensive possibility for producing an elastically deformable element. In particular, the elastically deformable element can be formed by way of a spring plate. Here, the second positioning element can be formed by a section of the spring plate which faces the first positioning element. The elastically deformable element preferably has holes, through which screws can be guided, with the aid of which the card reader can be fastened to the spring plate.

Furthermore, it is advantageous if the elastically deformable element enables a pivoting movement of the card reader which is coupled to the elastically deformable element, preferably about a rotational axis. As a result, a simple lever arrangement for pivoting the card reader is provided, which simple lever arrangement is of mechanically particularly simple construction.

Furthermore, it is advantageous if the elastically deformable element is connected releasably to the housing or fixedly to a frame element which is connected to the housing. For example, the elastically deformable element can be fastened to the housing or the frame element with the aid of screws. As a result, the elastically deformable element can be removed from the housing for maintenance, preferably together with the card reader.

The assembly preferably comprises a frame element which is arranged in an interior space of the housing and to which the elastically deformable element is connected. The frame element can be configured as a trough, in which the elastically deformable element is arranged. The elastically deformable element can be connected fixedly or releasably to the frame element. Furthermore, further components of the assembly can be arranged on and/or at the frame element. The frame element can be disconnected, in particular, from further frame elements and/or the housing, and can be removed through a maintenance opening which is arranged on that side of the housing which faces the flap. As a result, simple maintenance of the components, in particular of the card reader, which are arranged on and/or at the frame element is possible.

The assembly can be a self-service machine, in particular an ATM, a lottery terminal, a fuel terminal or an automated pay station.

The flap of the housing preferably comprises further openings, for example for dispensing a printed receipt, dispensing coupons or arranging a display and/or input element.

On an outer side, the flap can comprise covering elements for covering and/or bordering components and modules which are integrated into the flap. The covering elements can be, in particular, injection molded parts, preferably made from a plastic.

The cards which are introduced into the card reader and/or are dispensed by way of the card reader can be user cards, identification cards or bank cards (also called debit cards).

BRIEF DESCRIPTION OF THE DRAWINGS

Further features and advantages of the invention result from the following description which explains the invention in greater detail on the basis of one exemplary embodiment in conjunction with the appended figures, in which.

DETAILED DESCRIPTION

Figure 1:
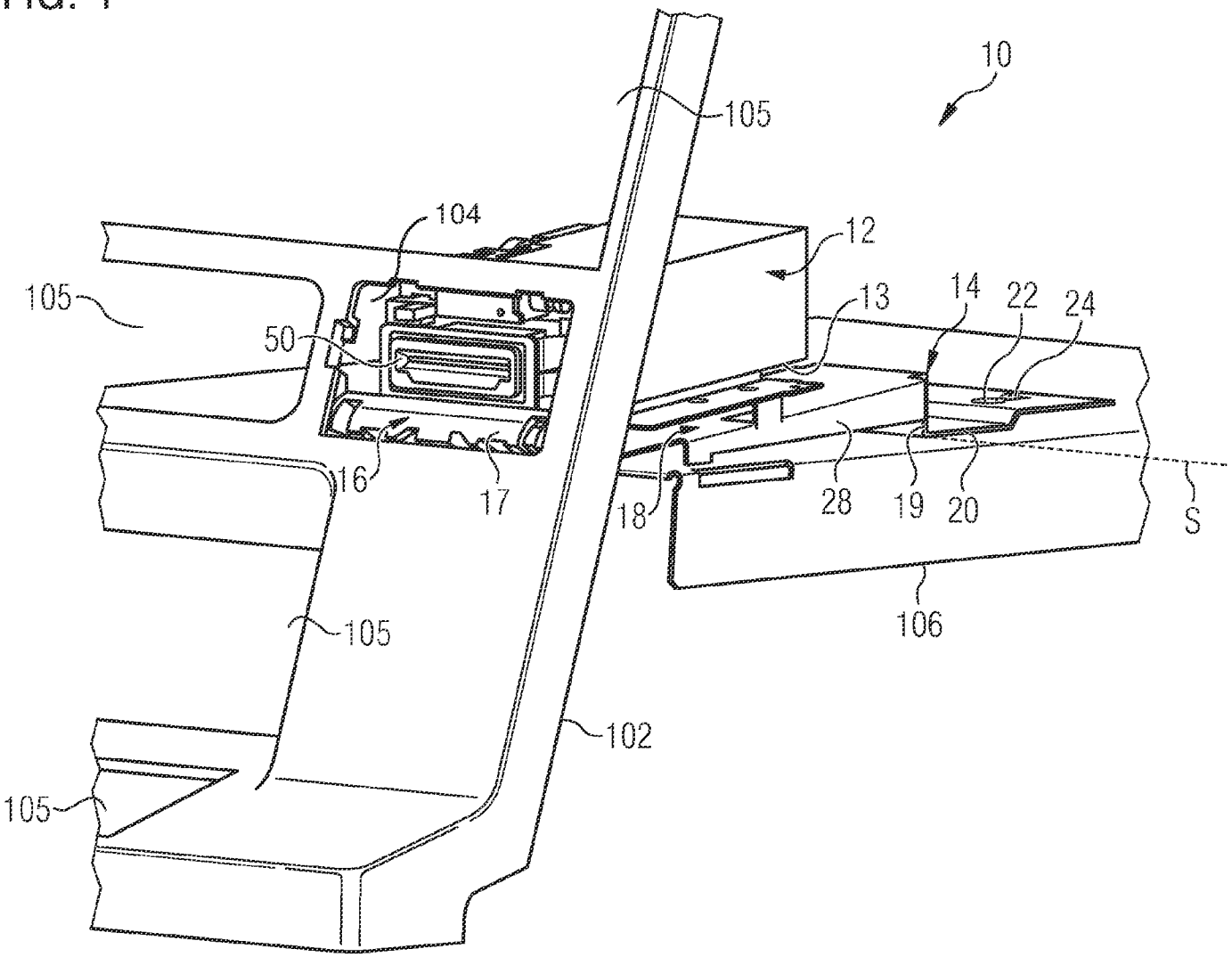
FIG. 1 shows a perspective illustration of an assembly with a card reader in accordance with one exemplary embodiment which is arranged in a housing.
Figure 3:
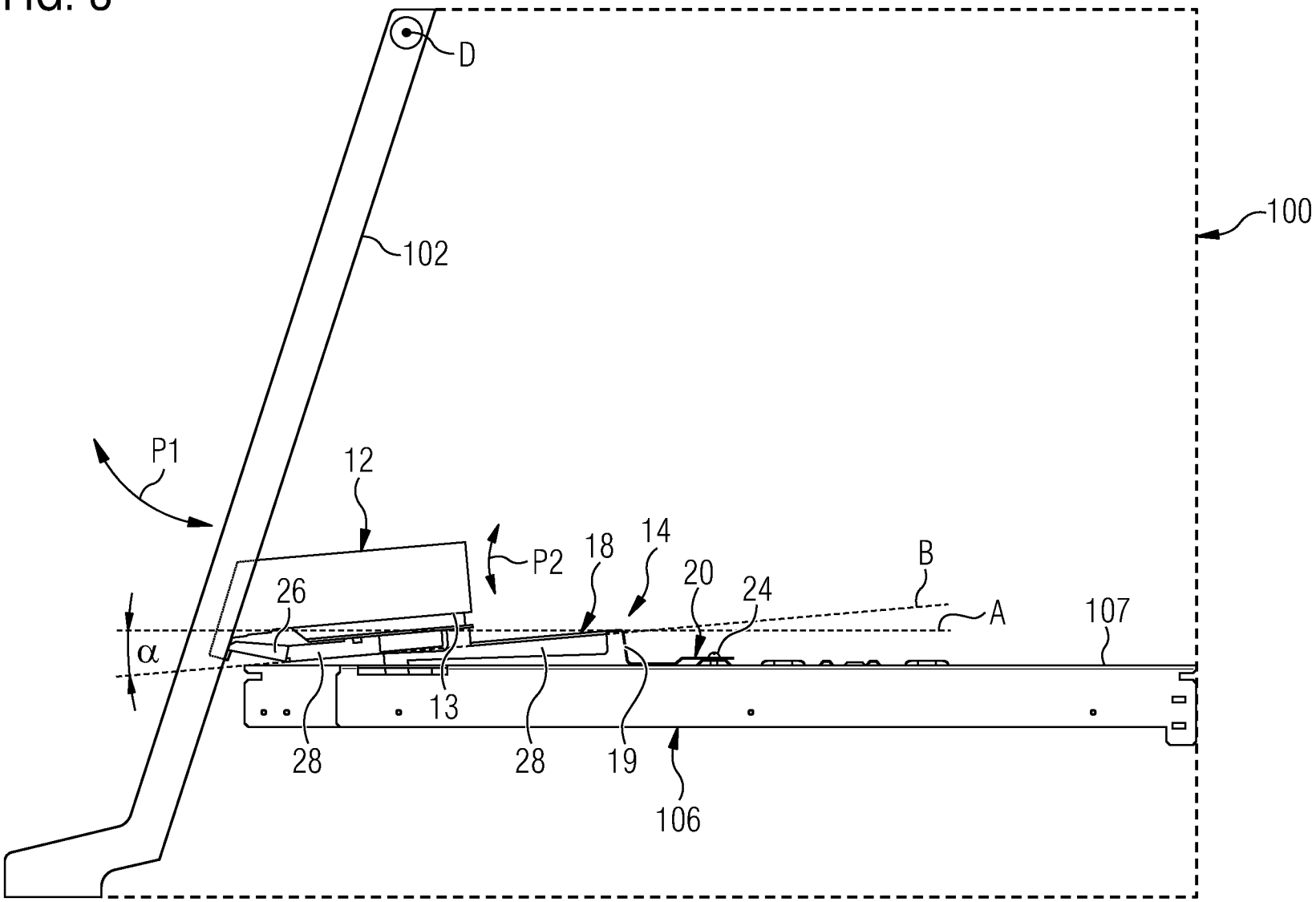
FIG. 3 shows a side view of the assembly in accordance with the exemplary embodiment according to FIG. 1.

FIG. 1 shows a perspective illustration of an assembly 10 with a card reader 12 in accordance with one exemplary embodiment which is connected to a frame element 106 of the assembly 10. Furthermore, the assembly 10 comprises an elastically deformable element 14 and a first positioning element 16. Furthermore, the assembly 10 comprises a pivotable flap 102 which is connected to the frame element 106 via further frame elements or housing elements (not shown) of a housing 100 of the assembly 10, and can be pivoted about a rotational axis D. The housing 100 is indicated in FIG. 3 by way of a dashed line. The rotational axis P is likewise shown in FIG. 3.

The flap 102 can be pivoted about the rotational axis D from an open state into a closed state. The movement of the flap 102 from the open state into the closed state and from the closed state into the open state is shown in FIG. 3 on the basis of a first double arrow P1. In the open state, access is possible to an interior space of the housing 100, in particular to the card reader 12. In the closed state, the access to the interior space of the housing 100 is prevented. FIG. 1 shows the flap 102 in the closed state. The flap 102 has an opening 104, through which a card can be fed to the card reader 12 and can be dispensed by way of the card reader 12 in the closed state of the flap 102. Furthermore, the flap 102 has further openings for arranging, for example, a display element and an input element, in particular a keyboard for inputting a PIN code, and for dispensing a printed receipt and coupons. The further openings are denoted in general by way of the designation 105.

Figure 2:
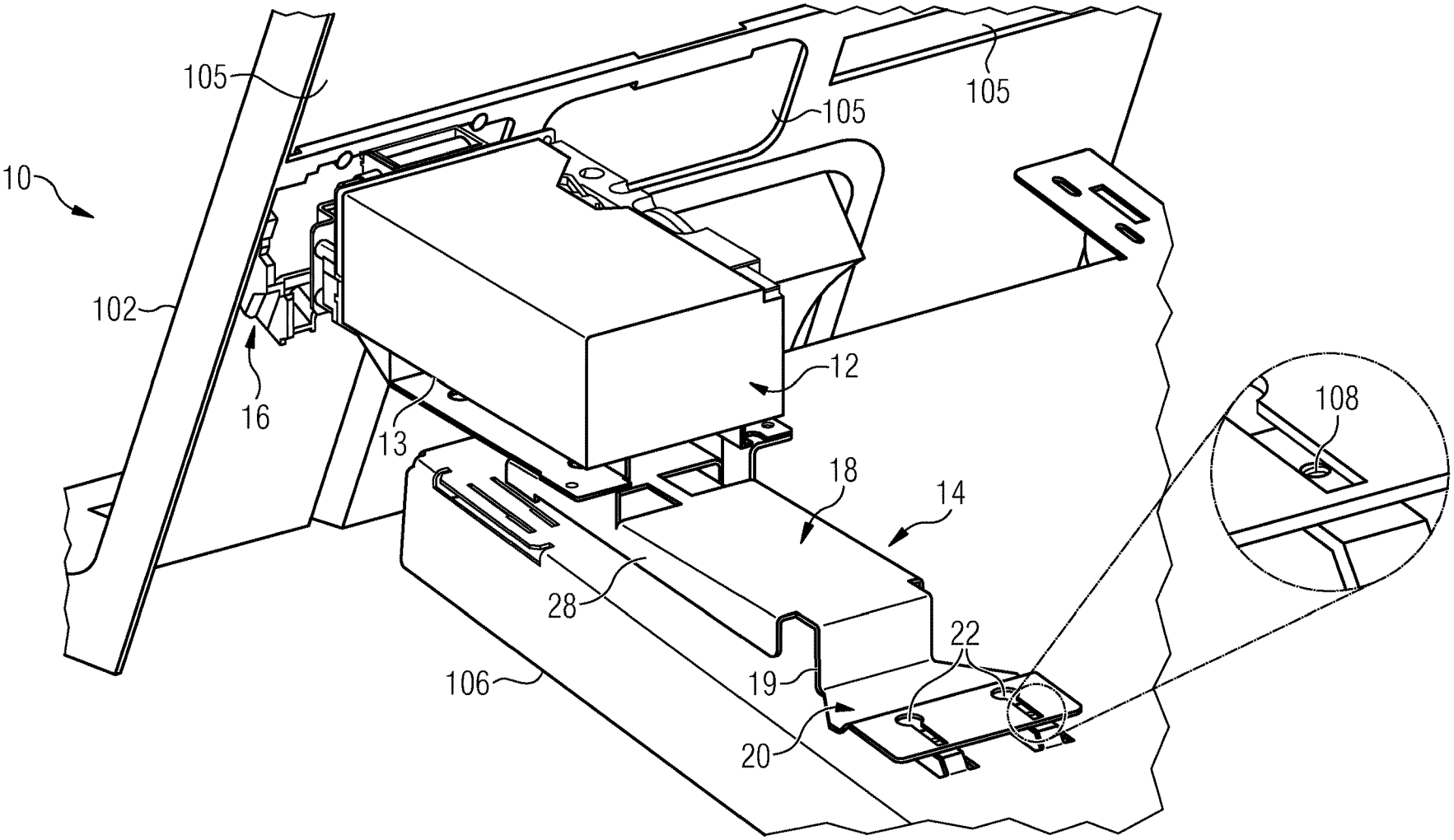
FIG. 2 shows a further perspective illustration of the assembly in accordance with the exemplary embodiment according to FIG. 1.

The frame element 106 has two internal threads 108 which are shown in FIG. 2 and into which in each case one screw 24 is screwed for releasably fastening the elastically deformable element 14. With the aid of the screws 24, the elastically deformable element 14 is connected fixedly to the frame element 106. The card reader 12 is connected to the elastically deformable element in such a way that a card input slot 50 of the card reader 12 points in the direction of the opening 104 of the flap 102.

The elastically deformable element 14 is formed by way of a spring plate which is bent substantially in a step-shaped manner and has an upper step-shaped part 18 which faces the flap 102 and a lower step-shaped part 20 which faces away from the flap 102, which parts 18, 20 are connected to one another via a connecting region 19. The upper step-shaped part 18 of the elastically deformable element 14 is arranged at a spacing from and above the frame element 106. By way of deformation of the region 19, the upper part 18 and therefore the card reader 12 which is connected to it can be pivoted.

The deformation can bring about, in particular, pivoting of the upper step-shaped part about a pivot axis S. In the case of other embodiments, the pivot axis can be at another location, or the pivoting takes place via arcuate bending of the region 19 and/or the parts 18, 20. A lever, by way of which the card reader 12 is held, is formed by way of the step-shaped configuration of the elastically deformable element 14.

Figure 4:
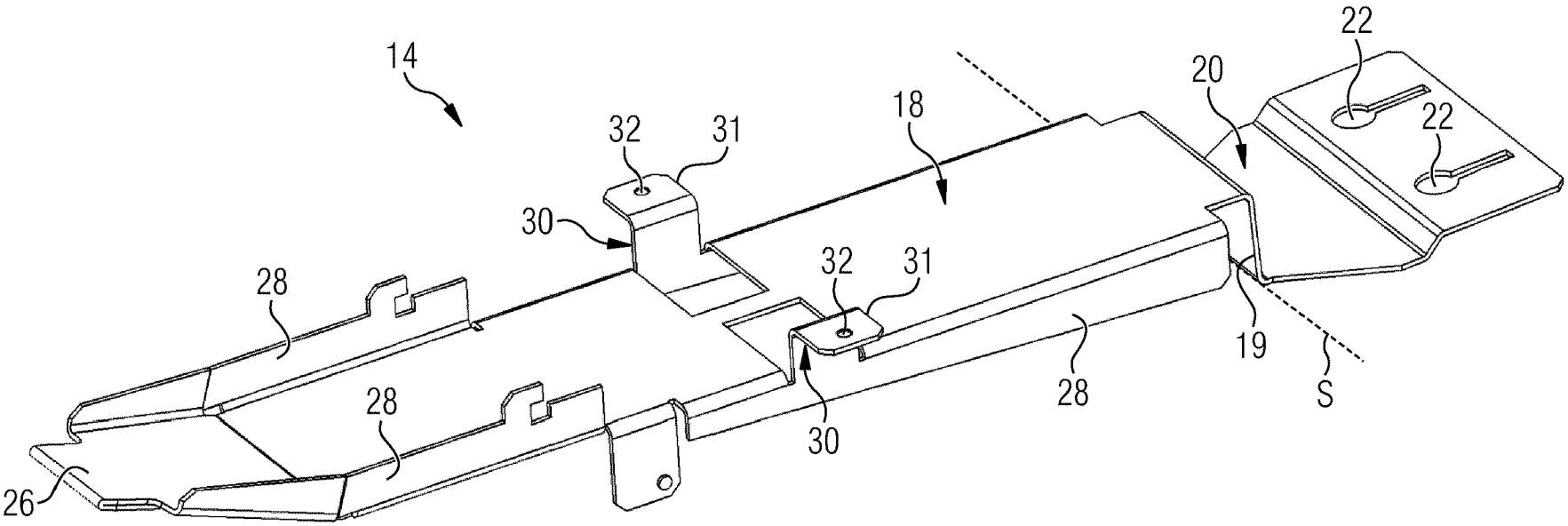
FIG. 4 shows a perspective illustration of an elastically deformable element of the assembly in accordance with the exemplary embodiment according to FIG. 1.

The upper step-shaped part 18 has a second positioning element 26 as a bracket at that end of the upper step-shaped part 18 which faces the flap 102, and two internal threads 32 which are shown in FIG. 4 and into which in each case one screw is screwed, with the aid of which the card reader 12 is arranged on the upper side of the upper step-shaped part 18 and is connected fixedly to the latter.

In the exemplary embodiment which is shown, the upper step-shaped part 18 has, furthermore, four stiffening elements 28. The four stiffening elements 28 might be omitted in alternative refinements of the elastically deformable element 14.

As a result of the weight of the card reader 12, the upper step-shaped part 18 and the card reader 12 which is arranged on the upper step-shaped part 18 are inclined in the direction of the opening 104 of the flap 102 in the open state of the flap 102. The inclination of the upper step-shaped part 18 and the card reader 12 is shown on the basis of FIG. 3. The lower step-shaped part 20 of the elastically deformable element 14 lies substantially on the frame element 106, and has two slots 22 which, in the exemplary embodiment which is shown, have a widened region for guiding through a screw head. In each case one screw 24 which is screwed into one of the two internal threads 108 of the frame element 106 is guided through the two holes 22. As a result, the elastically deformable element 14 is connected releasably to the frame element 106. The elastically deformable element 14 will be described in greater detail in the following text in conjunction with FIG. 4.

The first positioning element 16 is arranged substantially on the inner side of the flap 102. The first positioning element 16 has a wedge-shaped first guide element 17 which protrudes through the opening 104 and serves to guide the card in the direction of the card input slot 50 of the card reader 12. In the case of the movement of the flap 102 from the open state into the closed state, the first positioning element 16 is brought into engagement with the second positioning element 26 of the elastically deformable element 14. Here, the upper step-shaped part 18 of the elastically deformable element 14 is moved downward into a predefined position. Said movement is illustrated in FIG. 3 by way of a second double arrow P2. The predefined position is likewise shown in FIG. 3. The first positioning element 16 will be described in greater detail in the following text in conjunction with FIG. 5.

FIG. 2 shows a further perspective illustration of the assembly 10 in accordance with the exemplary embodiment according to FIG. 1. The perspective illustration in FIG. 2 is selected in such a way that the inner side of the flap 102 can be seen. In FIG. 2, an illustration of the two screws 24 for releasably fastening the elastic element 14 has been dispensed with, with the result that the two internal threads 108 of the frame element 106 can be seen.

FIG. 3 shows a side view of the assembly 10 in accordance with the exemplary embodiment according to FIG. 1. FIG. 3 shows a first axis A which is parallel to a lateral edge 107 of the frame element 106, and is horizontal in the intended state of the assembly 10. Furthermore, FIG. 3 shows a second axis B which is parallel to a lateral edge 13 of the card reader 12. In the intended state of the assembly 10, the inclination of the second axis B corresponds to the inclination of the card reader 12 relative to a horizontal plane, in which the axis A runs. The first axis A and the second axis B intersect at an inclination angle $\alpha$, the value of which indicates the inclination of the card reader 12 relative to the frame element 106 or to the horizontal plane. In the open state of the flap 102, the inclination angle $\alpha$ has the value of, for example, 3° and, in the closed state of the flap 102, that is to say when the card reader 12 is situated in the predefined position, the inclination angle $\alpha$ has the value of, for example, 5°. A penetration of rainwater through the card input slot 50 into the card reader 12 is prevented, in particular, by way of the inclination of the card reader 12 in the direction of the flap 102. Furthermore, FIG. 3 shows the movement of the flap 102 from the open state into the closed state by way of the first double arrow P1. The movement of the front part 18 of the elastically deformable element 14 in the case of the first positioning element 16 being brought into engagement with the second positioning element 26 of the elastically deformable element 14 is shown in FIG. 3 by way of the second double arrow P2.

FIG. 4 shows a perspective illustration of the elastically deformable element 14 of the assembly in accordance with the exemplary embodiment according to FIG. 1. FIG. 4 shows, in particular, two fastening elements 30 which are arranged laterally on the front part 18 of the elastically deformable element 14. The fastening elements 30 are configured by way of example as L-shaped brackets which in each case have a horizontal limb 31 which is arranged above the front part 18. In each case one of the two internal threads 32 of the elastically deformable element 14 is configured in the horizontal limb 31. With the aid of the fastening elements 30, the card reader 12 can be arranged simply by way of screws on the upper side of the upper step-shaped part 18, and can be connected fixedly to the upper step-shaped part 18.

Figure 5:
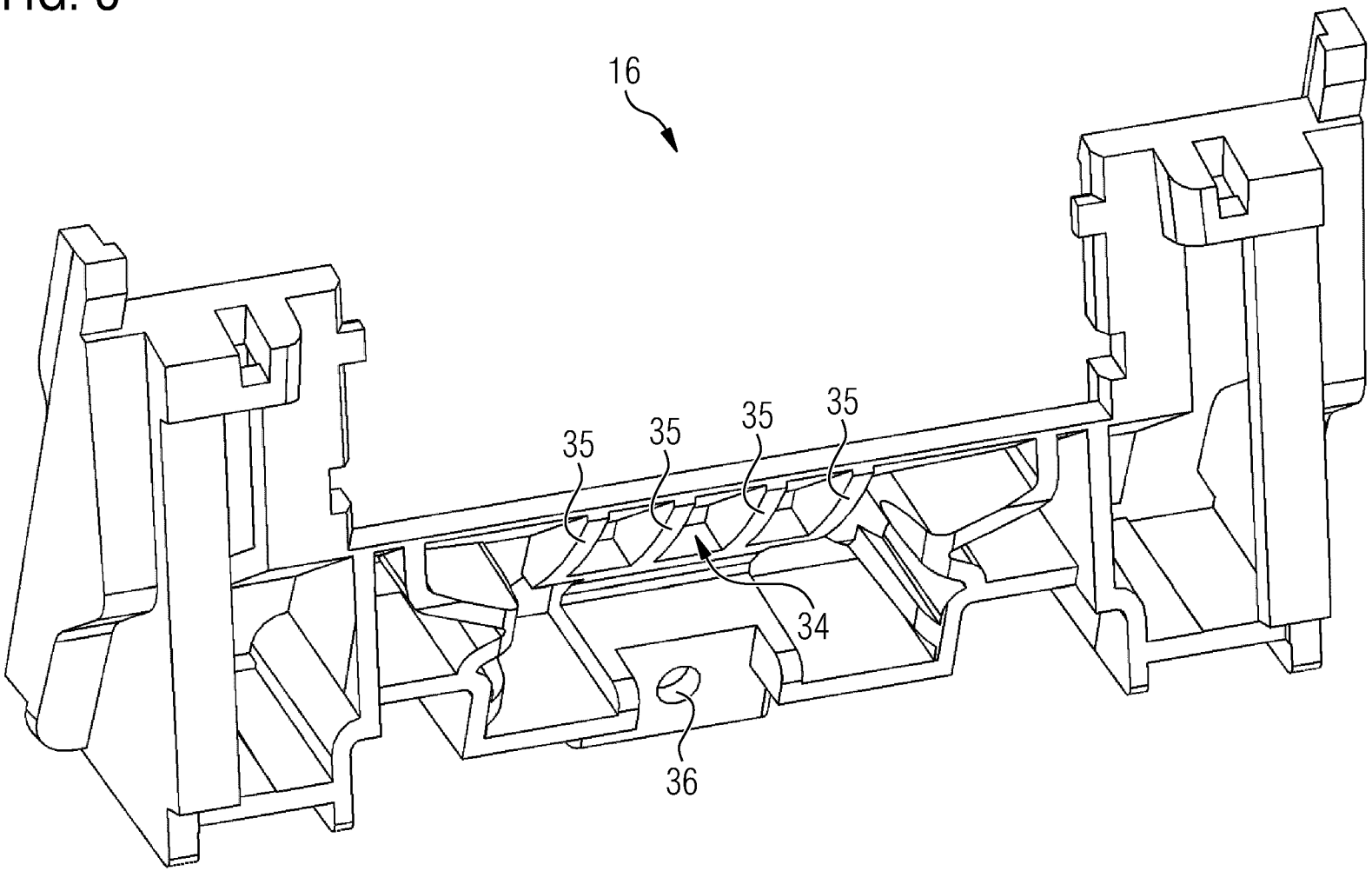
FIG. 5 shows a perspective illustration of a first positioning element of the assembly in accordance with the exemplary embodiment according to FIG. 1.

FIG. 5 shows a perspective illustration of the first positioning element 16 of the assembly 10 in accordance with the exemplary embodiment according to FIG. 1. FIG. 5 shows the positioning element 16 as viewed from the interior space of the housing 100. The positioning element 16 has a second guide element 34 which comprises wedge-shaped struts 35. In the case of the movement of the flap 102 from the open state into the closed state, the second positioning element 26 comes into contact with the second guide element 34 and, as a result, presses the front part 18 of the elastically deformable element 14 downward. Furthermore, the positioning element 16 has a through hole 36 which is arranged below the second guide element 34. A screw can be guided through the through hole 36, which screw is screwed into an internal thread which is provided in the flap 102, in order to connect the positioning element 16 fixedly to the flap 102, with the result that it is a constituent part of the flap 102.

Figure 6:
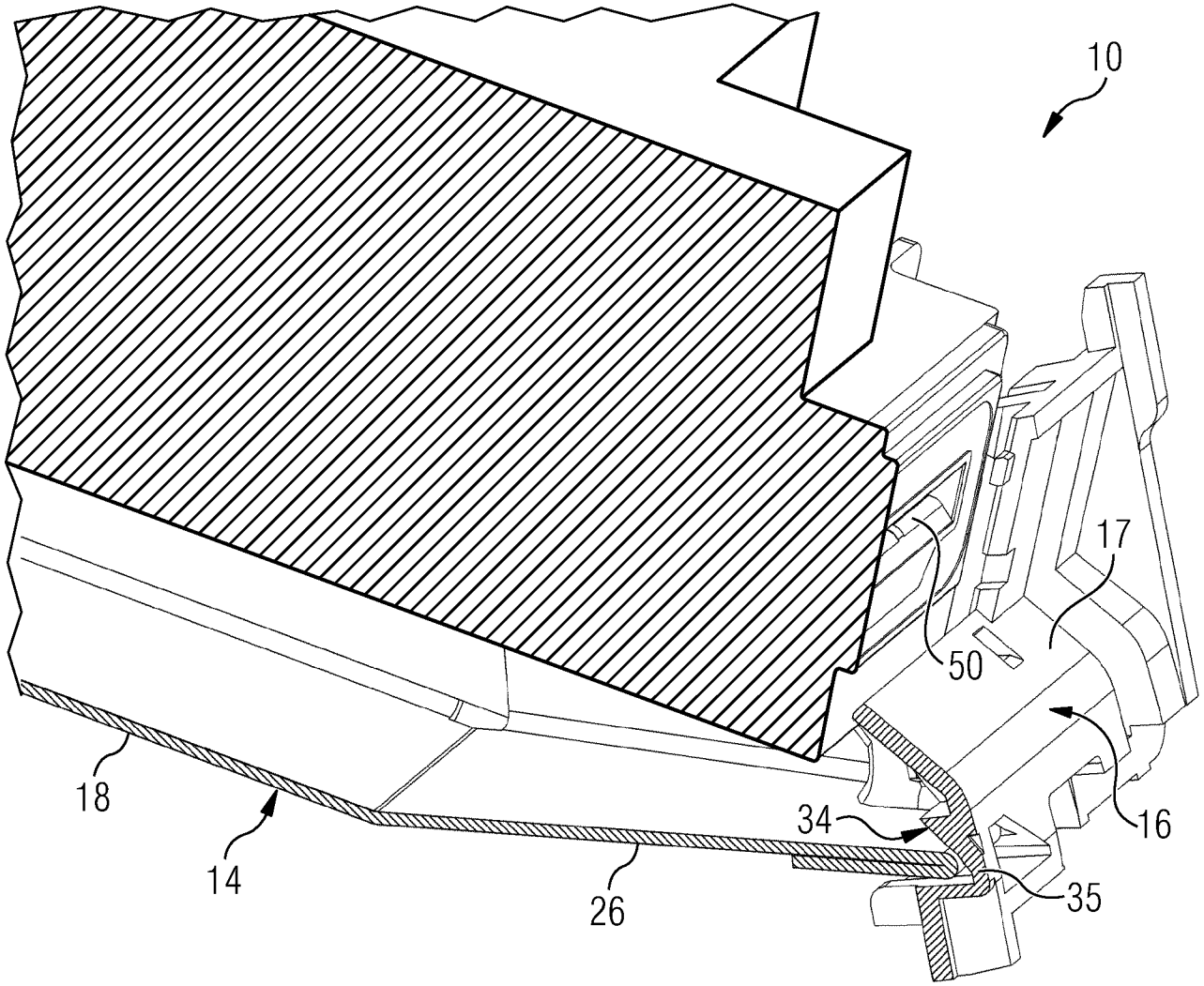
FIG. 6 shows a perspective sectional illustration of a part of the assembly in accordance with the exemplary embodiment according to FIG. 1.

FIG. 6 shows a perspective sectional illustration of a part of the assembly 10 in accordance with the exemplary embodiment according to FIG. 1. The sectional plane is perpendicular with respect to the flap 102, and runs centrally through the card reader 12. FIG. 6 shows a part of the card reader 12 which faces the flap 102, the front part 18 of the elastically deformable element 14, and the first positioning element 16. The second positioning element 26 comes into contact with the webs 35 of the first guide element 34 of the first positioning element 16. As a result, the second positioning element 26 is in engagement with the first positioning element 16, as a result of which a movement of the second positioning element 26 upward and downward is prevented reliably.

The invention claimed is:

1. An assembly with a card reader which is arranged in a housing comprising:

a frame element;

the card reader; and the housing including a pivotable flap which, in an open state, enables access to the card reader, and which, in a closed state, prevents access to the card reader, and the pivotable flap having an opening, through which a card can be fed to the card reader and can be dispensed by way of the card reader in the closed state of the pivotable flap, wherein the pivotable flap is connected to the frame element via the housing, characterized in that the assembly has an elastically deformable element for resiliently mounting the card reader, the elastically deformable element connected fixedly to the frame element and connected to the card reader in that the assembly has a first positioning element for positioning the card reader, which first positioning element is arranged on the pivotable flap so as to lie opposite the card reader in the closed state of the pivotable flap, and in that the first positioning element moves the card reader, in the case of the movement of the pivotable flap from the open state into the closed state, in such a way that, in the closed state of the pivotable flap, the card reader is arranged in a predefined position relative to the pivotable flap.

2. The assembly as claimed in claim 1, characterized in that the elastically deformable element has a second positioning element, and in that, in the case of the movement of the pivotable flap from the open state into the closed state, the first positioning element is brought into engagement with the second positioning element in order to position the card reader.

3. The assembly as claimed in claim 1, characterized in that the card reader has a second positioning element, and in that, in the case of the movement of the pivotable flap from the open state into the closed state, the first positioning element is brought into engagement with the second positioning element in order to position the card reader.

4. The assembly as claimed in claim 2 or 3, characterized in that the elastically deformable element is prestressed in such a way that the second positioning element is pressed against the first positioning element in the closed state of the pivotable flap.

5. The assembly as claimed in one of claims 1 to 3, characterized in that the elastically deformable element is prestressed by way of the weight of the card reader.

6. The assembly as claimed in one of claims 1 to 3, characterized in that the elastically deformable element is of single-piece configuration.

7. The assembly as claimed in one of claims 1 to 3, characterized in that the elastically deformable element comprises a spring plate.

8. The assembly as claimed in one of claims 1 to 3, characterized in that the elastically deformable element enables a pivoting movement of the card reader which is coupled to the elastically deformable element.

9. The assembly as claimed in one of claims 1 to 3, characterized in that the elastically deformable element is connected releasably to the housing or to the frame element of the housing.

10. The assembly as claimed in one of claims 1 to 3, characterized by the frame element which is arranged in an interior space of the housing and to which the elastically deformable element is connected fixedly.

* * * * *